US012733730B2

(12) United States Patent
Fritsch et al.

(10) Patent No.: US 12,733,730 B2
(45) Date of Patent: Sep. 15, 2026

(54) BACKPACK

(71) Applicant: Gossamer Gear, Inc., Austin, TX (US)

(72) Inventors: Greg Fritsch, Chico, CA (US); Carrie Fritsch, Chico, CA (US)

(73) Assignee: Gossamer Gear Inc., Austin, TX (US)

( * ) Notice: Subject to any disclaimer, the term of this patent is extended or adjusted under 35 U.S.C. 154(b) by 78 days.

(21) Appl. No.: 18/829,098

(22) Filed: Sep. 9, 2024

(65) Prior Publication Data

US 2025/0089878 A1 Mar. 20, 2025

Related U.S. Application Data

(60) Provisional application No. 63/583,155, filed on Sep. 15, 2023.

(51) Int. Cl.

| | |
|---|---|
| ***A45F 3/08*** | (2006.01) |
| ***A45C 13/10*** | (2006.01) |
| ***A45F 3/04*** | (2006.01) |

(52) U.S. Cl.

CPC ..... *A45F 3/08* (2013.01); *A45C 13/10* (2013.01); *A45F 3/047* (2013.01); *A45C 2013/1015* (2013.01); *A45F 2003/045* (2013.01)

(58) Field of Classification Search

CPC .... A45F 3/08; A45F 3/047; A45F 3/04; A45F 3/14; A45F 3/10; A45F 2003/045; A45F 2003/146; A45F 2003/144

USPC ..... 224/262, 633, 637, 642, 662, 663, 628, 224/634, 636

See application file for complete search history.

(56) References Cited

U.S. PATENT DOCUMENTS

| | | | | |
|---|---|---|---|---|
| 4,074,839 | A * | 2/1978 | Wood | A45F 3/08 224/635 |
| 5,954,253 | A * | 9/1999 | Swetish | A45F 3/08 224/628 |
| 6,634,533 | B2 * | 10/2003 | Thompson | A45F 3/047 224/663 |
| 7,770,766 | B2 * | 8/2010 | Foissac | A45F 3/047 224/628 |
| 9,636,875 | B2 * | 5/2017 | Hairston | A45F 3/047 |
| 10,368,626 | B2 * | 8/2019 | Roque | A45F 3/04 |

OTHER PUBLICATIONS

Arc'teryx, screen shots of youtube video, The New Arc'teryx Bora Backpacks, https://www.youtube.com/watch?v=TsGocx5os5E, Feb. 22, 2017, 1 page.

Granite Gear, Ultralight Belt—Custom Accessories—Granite Gear, printed Sep. 4, 2024, 1 page.

(Continued)

*Primary Examiner* — Corey N Skurdal

(74) *Attorney, Agent, or Firm* — Klarquist Sparkman, LLP

(57) ABSTRACT

A backpack includes a pack portion adapted to receive and store contents, two shoulder straps connected to the pack portion, a belt portion adapted to be worn around a waist of a user, and a frame. The belt portion includes a frame pocket. The frame includes an upper portion and a lower portion, wherein the upper portion is coupled to the pack portion and the lower portion is disposed in the frame pocket such that the frame can transfer weight from the pack portion to the belt portion. The frame pocket is adapted to pivot relative to the lower portion of the frame such that the belt portion can pivot relative to the frame and the pack portion.

18 Claims, 10 Drawing Sheets

(56) References Cited

OTHER PUBLICATIONS

Klattermusen, screen shots of youtube video, Raido Trekking Backpack, https://youtu.be/uilefJmi5eU, Oct. 6, 2000, 1 page.
Klattermusen, https://www.klattermusen.com/en/backpacks/multi-day-backpacks/10209-raido-2.0-backpack-551-raven/, Raido 2.0, Lightweight Retina® Backpack 55L, printed Sep. 4, 2024, 4 pages.
Kuiu, https://www.kuiu.com/products/pro-suspension-phantom?variant=40340225327262&gclid=CjwKCAjw6eWnBhAKEiwADpnw9vKi7m--DN7xXMo07K-KqYu4WD8HUeWIinX3AXxhJ6KOZ1CvexyRoC50YQAvD_BWE, PRO Suspension / Phantom—KUIU, printed Sep. 4, 2024, 9 pages.
https://www.endurancesportswire.com/mountain-hardwear-launches-PCT-pack-unveiling-dynamic-new-hoverbelt-technology/, "Mountain Hardwear Launches PCTTM Pack Unveiling Dynamic New Hoverbelt Technology", May 26, 2021, 5 pages.
Mountain Hardware, https://www.mountainhardwear.com/p/PCT-551-backpack-1938271.html, PCT™ 55L Backpack / Mountain Hardwear, printed Sep. 4, 2024, 4 pages.
Out&Back, https://outandbackoutdoor.com/products/infinity-60-pack, Infinity 60 Pack Black Diamond, printed Sep. 4, 2024, 4 pages.

* cited by examiner

BACKPACK

CROSS REFERENCE TO RELATED APPLICATIONS

This application claims the benefit of U.S. Provisional Patent Application No. 63/583,155, filed Sep. 15, 2023, which is incorporated herein by reference.

FIELD

The present application relates to a backpack, and in particular, a backpack having a belt portion that can pivot relative to a pack portion while a user walks or hikes.

BACKGROUND

Backpacks typically comprise a pack portion, usually made of relatively flexible (non-rigid) materials such as panels of textile fabrics, which forms a compartment adapted to receive a load to be carried. The pack portion comprises a back side which is positioned against the back of the user when it is worn. The backpack also has a carrying system, which typically includes a pair of shoulder straps and sometimes a belt portion worn around the waist of a user.

SUMMARY

In some examples, a backpack comprises a pack portion adapted to receive and store contents; a belt portion adapted to be worn around a waist of a user; and a frame coupled to the pack portion and the belt portion; wherein the belt portion comprises a main body and reinforcing member coupled to the main body, wherein the reinforcing member comprises a frame pocket that receives a lower portion of the frame and allows the belt portion to pivot relative to the frame and the pack portion.

In some examples, the lower portion of the frame has a single radius of curvature.

In some examples, the lower portion has a shape that corresponds to a portion of a circle.

In some examples, the reinforcing member comprises a first panel and a second panel connected to the first panel, wherein the first panel and the second panel form the frame pocket.

In some examples, the first panel comprises a central section and two side sections extending laterally from opposite sides of the central section, wherein the side sections are sized to extend over the hips of a user.

In some examples, each side section comprises a plurality of legs extending from opposite sides of the central section.

In some examples, each leg is disposed within a respective pocket in the main body of the belt portion.

In some examples, the first panel is more rigid than the main body of the belt portion.

In some examples, the first panel is made of a molded polymer.

In some examples, the frame comprises two upwardly extending, laterally spaced side portions that extend upwardly from opposing ends of the lower portion and an upper portion that extends laterally between upper ends of the side portions.

In some examples, the side portions and the upper portion of the frame extend into pack portion.

In some examples, a backpack comprises: a pack portion adapted to receive and store contents; two shoulder straps connected to the pack portion; a belt portion adapted to be worn around a waist of a user, the belt portion comprising a frame pocket; and a frame comprising an upper portion and a lower portion, wherein the upper portion is coupled to the pack portion and the lower portion is disposed in the frame pocket of the belt portion such that the frame can transfer weight from the pack portion to the belt portion; wherein the frame pocket can pivot relative to the lower portion of the frame such that the belt portion can pivot relative to the frame and the pack portion.

In some examples, the belt portion comprises a main body configured to be worn around a waist of a user and a reinforcing member coupled to the main body, wherein the reinforcing member comprises the frame pocket.

In some examples, the reinforcing member comprises a panel that is more rigid than the main body of the belt portion, wherein the panel comprises a central section forming at least a portion of the frame pocket and two side sections extending laterally from opposite sides of the central section, wherein the side sections are sized to extend over the hips of a user.

In some examples, the side sections are disposed in respective pockets in the main body of the belt portion.

In some examples, the panel comprises a first panel and the reinforcing member comprises a second panel attached to the central section of the first panel, wherein the first panel and the second panel form the frame pocket.

In some examples, the upper portion of the frame is disposed in a pocket in the pack portion.

In some examples, the frame comprises a bent metal rod.

In some examples, the lower portion of the frame has a curvature corresponding to a portion of a circle.

In some examples, the reinforcing member is removably coupled to the main body with a hook-and-loop fastening mechanism.

In some examples, a backpack comprises: a pack portion adapted to receive and store contents; two shoulder straps connected to the pack portion, wherein the shoulder straps are adapted to be worn over the shoulders of a user so as to support the pack portion against the user's back; a belt portion comprising a main body configured to be worn around a waist of the user and a reinforcing member coupled to the main body, wherein the reinforcing member comprises a first panel and a second panel attached to the first panel to form a frame pocket, wherein the first panel comprises a central section and two side sections extending laterally from opposite sides of the central section, wherein each side section comprises a plurality of legs sized to extend over a hip of a user; and a frame comprising a bent metal rod, wherein the rod comprises a curved lower portion, two side portions extending upwardly from respective ends of the lower portion, and an upper portion extending laterally between respective upper ends of the side portions, wherein the curved lower portion has a curvature corresponding to a portion of a circle, wherein the upper portion is coupled to the pack portion and the lower portion is disposed in the frame pocket of the belt portion such that the frame can transfer weight from the pack portion to the belt portion; wherein the frame pocket can pivot relative to the lower portion of the frame such that the belt portion can pivot relative to the frame and the pack portion.

DETAILED DESCRIPTION

General Considerations

For purposes of this description, certain aspects, advantages, and novel features of examples of this disclosure are described herein. The present disclosure is directed toward all novel and nonobvious features and aspects of the various disclosed examples, alone and in various combinations and sub-combinations with one another. The methods, apparatus, and systems are not limited to any specific aspect or feature or combination thereof, nor do the disclosed examples require that any one or more specific advantages be present or problems be solved.

Although the operations of some of the disclosed examples are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "provide" or "achieve" to describe the disclosed methods. These terms are high-level abstractions of the actual operations that are performed. The actual operations that correspond to these terms may vary depending on the particular implementation and are readily discernible by one of ordinary skill in the art.

As used in this application and in the claims, the singular forms "a," "an," and "the" include the plural forms unless the context clearly dictates otherwise. Additionally, the term "includes" means "comprises." Further, the term "coupled" generally means physically, mechanically, chemically, magnetically, and/or electrically coupled or linked and does not exclude the presence of intermediate elements between the coupled or associated items absent specific contrary language.

Overview of the Disclosed Technology

As noted above, backpacks can include a carrying system that includes shoulder straps and a belt portion worn around the waist of a user. In use, the weight of the backpack and the contents stored therein is born by the shoulders and the hips of the user. During normal walking or hiking, the hips move up and down. Consequently, the weight transferred by the belt portion to the hips is constantly shifting between the left and right hips as the user walks or hikes, which can become uncomfortable and may be painful if a relatively heavy load is being carried. Disclosed herein are examples of backpacks that incorporate a belt portion that can pivot relative to the pack portion such that the belt portion can maintain a substantially equal distribution of weight around the user's hips during normal walking or hiking.

Examples of Disclosed Technology

Figure 1:
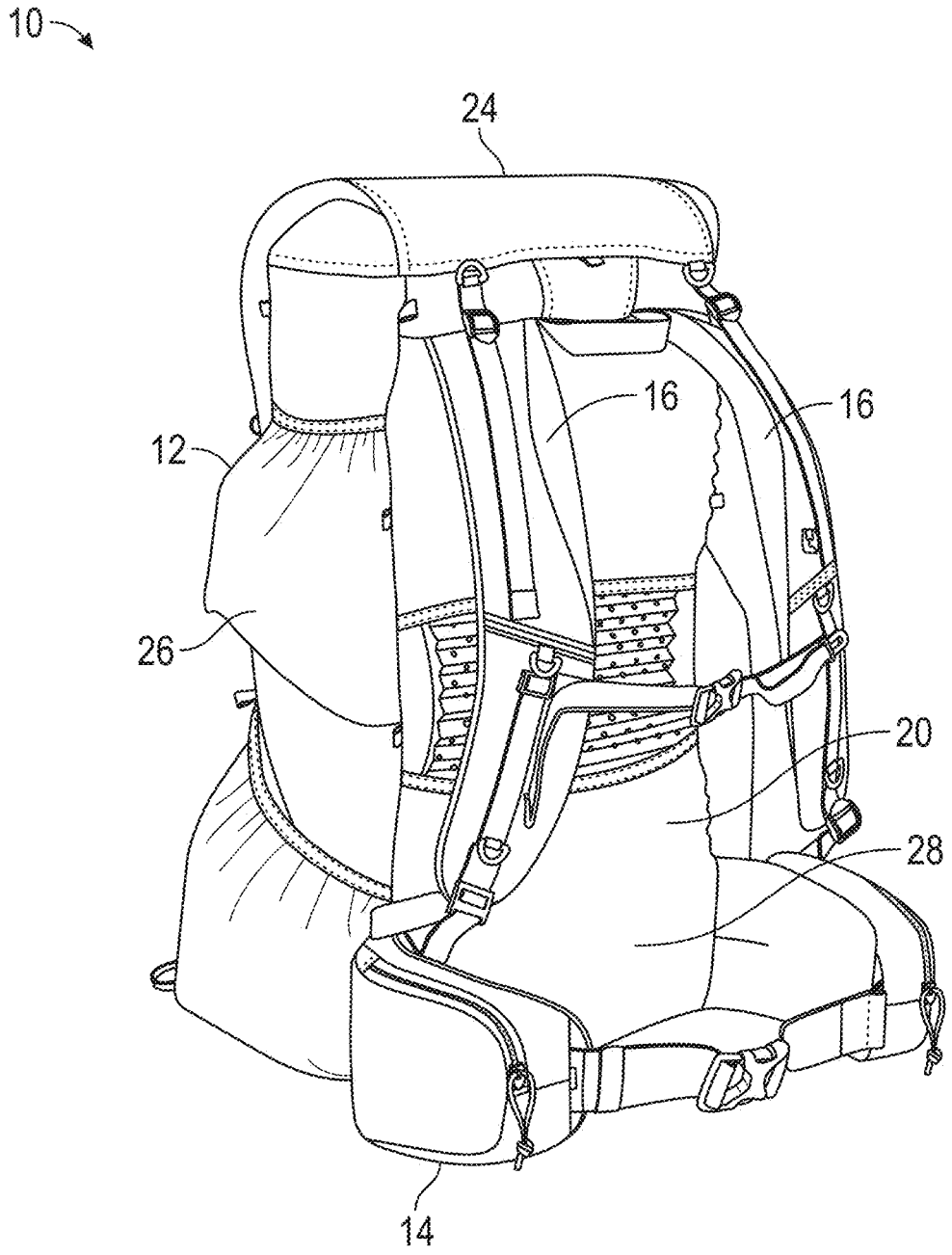
FIG. 1 is a back perspective view of a backpack, according to one example.
Figure 2:
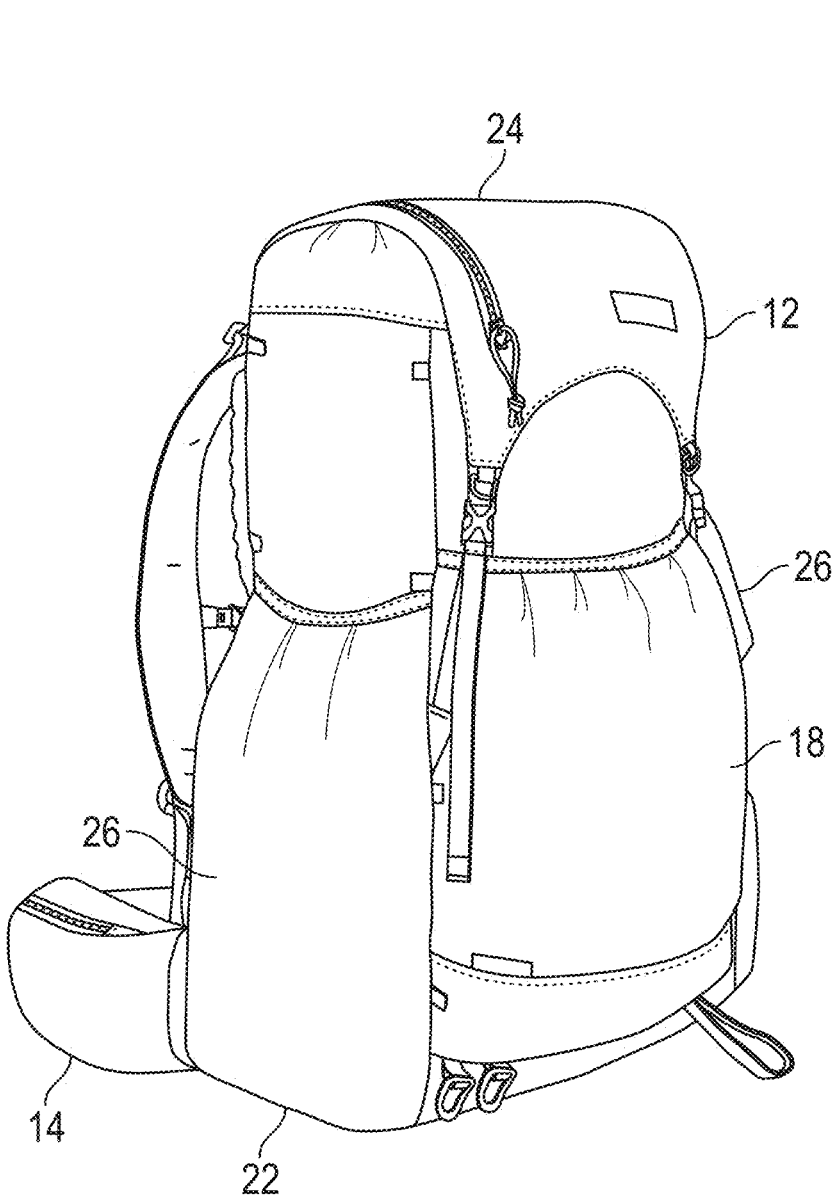
FIG. 2 is a front perspective view of the backpack of FIG. 1.

Referring first to FIGS. 1-2, there is shown a backpack 10, according to one example. The backpack 10 includes a pack portion 12, a belt portion 14 (also referred to as a "hip belt") coupled to the back portion 12, and shoulder traps 16 connected to the pack portion 12. The pack portion 12 can be made of a flexible material, such as a fabric, and can be formed from one or more panels or sheets of such materials stitched or otherwise connected to each other to form a front side 18, a backside 20, a bottom side 22, a top side 24, and two lateral sides 26. When worn by a user, the shoulder straps 16 extend over the user and the backside 20 faces the back of the user.

The pack portion 12 defines a main compartment between the front side 18, the backside 20, the bottom side 22, the top side 24, and the lateral sides 26. The main compartment can be accessed via the top side 24 for inserting and removing contents from the main compartment. The pack portion 12 can include one or more secondary compartments or pockets for storing items, as known in the art.

In some examples, the belt portion 14 may be removable or separatable from the pack portion 12. For example, the backside 20 of the pack portion 12 can comprise a panel 28, the lower end portion of which defines an opening or slot that is configured to receive the belt portion 14. The belt portion 14 can be inserted into and removed from the slot as desired. In other examples, the belt portion 14 can be fixedly attached to the panel 28, such as with stitching.

Figure 3:
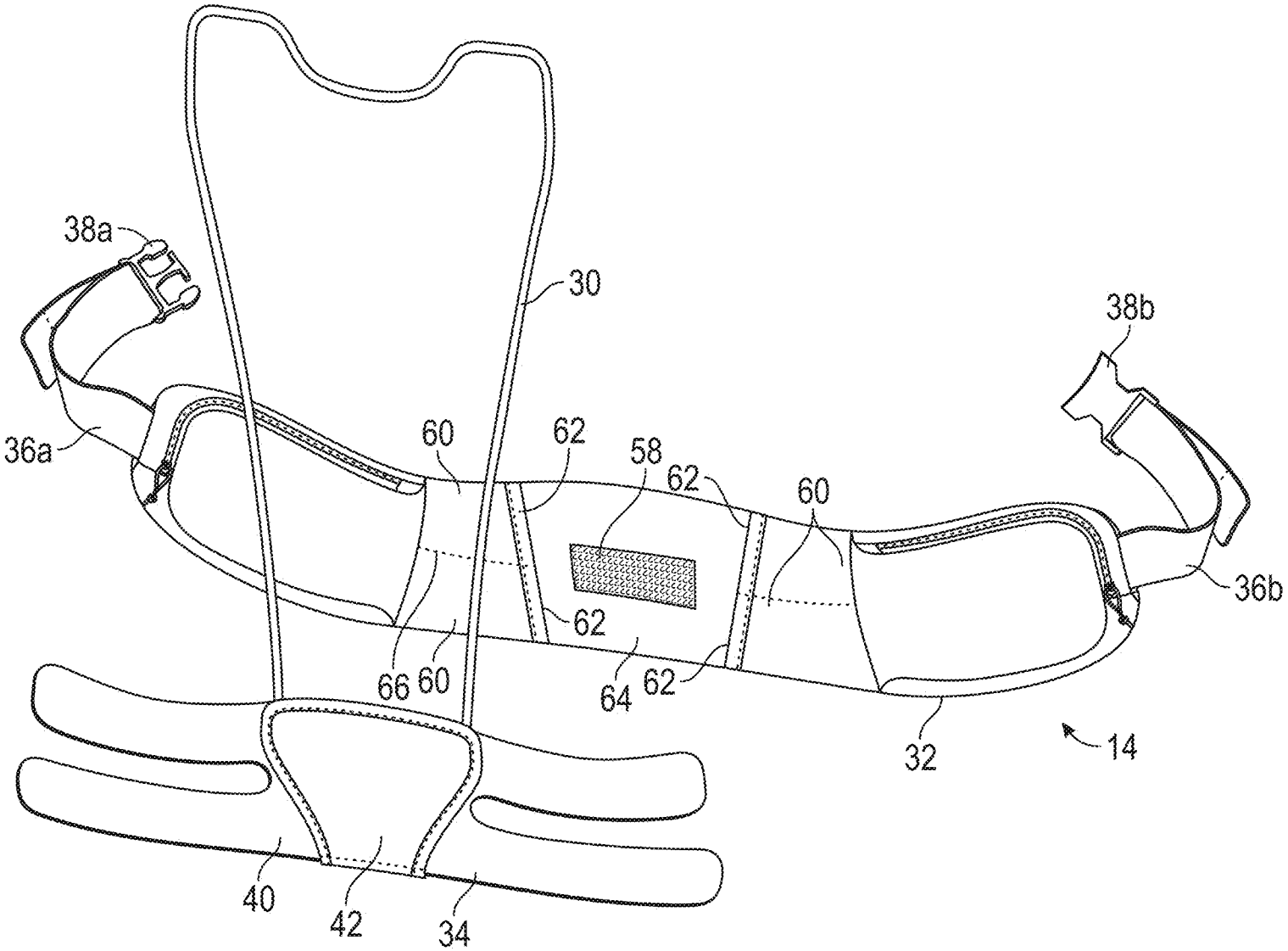
FIG. 3 is a partially exploded perspective view of a frame and a belt portion that can be incorporated into the backpack of FIG. 1, according to one example.

FIG. 3 shows an exploded view of the belt portion 14 and a stiffening frame 30 (also referred to as a frame element) that helps to transfer the weight of the pack portion 12 (and the contents of the pack portion 12) to the belt portion 14. The frame 30 may also help retain the shape of the pack portion 12.

The belt portion 14 comprises a main body 32 and a reinforcing member 34, which can be removably coupled to the main body 32. The belt portion 14 also can include adjustable straps 36*a*, 36*b* extending from opposite ends of the main body 32. Interlocking clipping members 38*a*, 38*b* can be connected to the free ends of the straps 36*a*, 36*b*, respectively, for securing the belt portion around the waist of the user, as known in the art. The main body 32 can be constructed from a fabric. In some examples, the main body can comprise an outer shell or outer layer made of a flexible material, such as a fabric, and optionally can include padding disposed inside the outer shell or otherwise covered by the outer layer of flexible material.

Figure 4A:
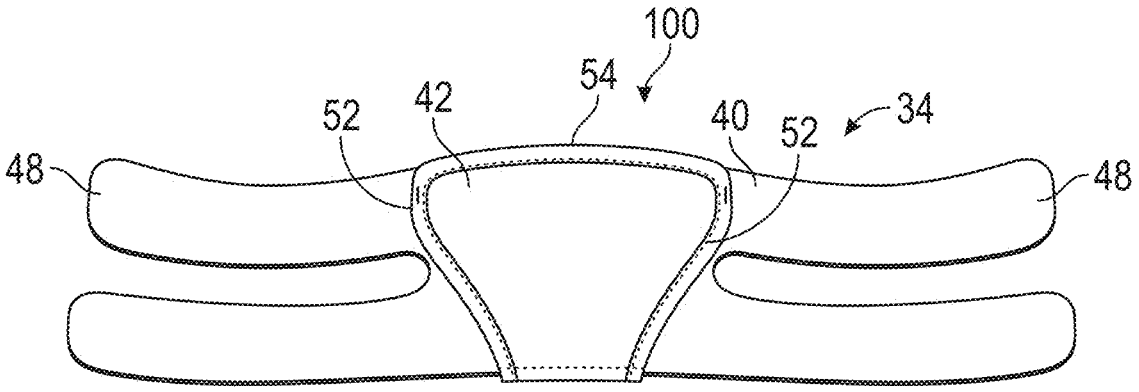
FIGS. 4A and 4B show opposite sides of a reinforcing member of the belt portion of FIG. 3.
Figure 4B:
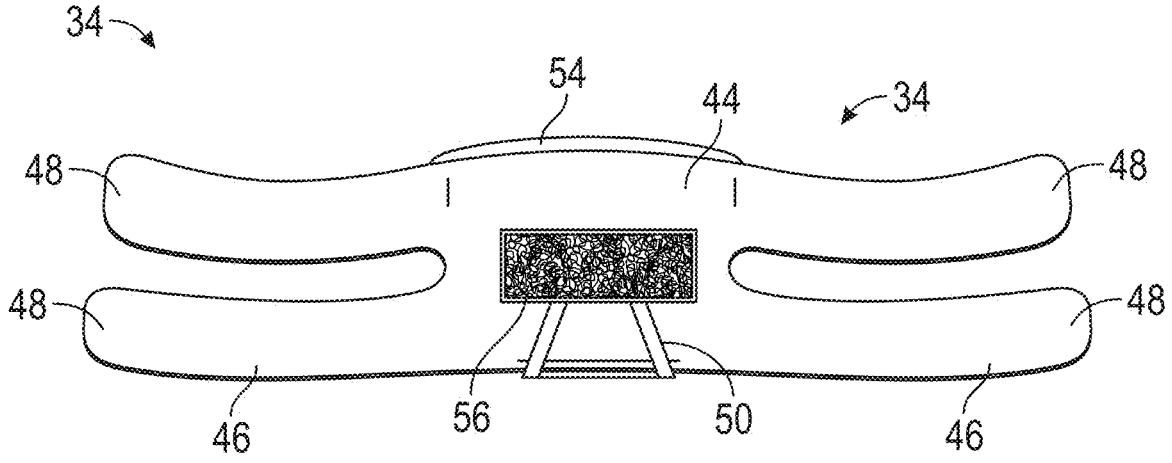

FIG. 4A shows a first, inner side of the reinforcing member 34, which faces toward the back of the user and away from the main body 32. FIG. 4B shows a second, outer side of the reinforcing member 34, which faces toward the main body 32 and away from the back of the user. As shown, the reinforcing member 34 comprises a first, main panel 40 and a second panel 42 connected to the main panel 40. The main panel 40 comprises a central section 44 and two side sections 46 extending laterally from opposite sides of the central section 44. In some examples, each side section 46 comprises a plurality of legs 48 spaced apart from each other along the height of the central section so as to define a slots or gaps between adjacent legs 48.

The second panel 42 is secured to the central section 44 on the inner side of the main panel 40 and can include a lower flap 50 that wraps around the lower edge of the main panel 40 and is secured to the central section 44 on the outer side of the main panel. The second panel 42 can be secured to the central section 44 along its side edges 52 but can be left unattached to the central section along its top edge 54 so as to define a frame pocket 100 (also referred to as a "frame socket") between the main panel 40 and the second panel 42 to receive a lower portion of the frame, as further described below. The opposing sides 52 of the second panel 42 can be secured to the central section 44 on the inner side of the main panel 40 using suitable techniques and mechanisms, such as with stitching, an adhesive, and/or mechanical fasteners. The upper edge 54 of the second panel 42 can be left unattached to the main panel 40 to define an opening of the frame pocket 100 for receiving a lower portion 68 of the frame 30. The flap 50 can be secured to the central section 44 on the outer side of the main panel 40 using suitable techniques and mechanisms, such as with stitching, an adhesive, and/or mechanical fasteners.

The frame pocket 100 can be formed by other structures or configurations of the reinforcing member 34 and/or the main body 32. For example, the main panel 40 can be molded or otherwise formed to have two layers defining the frame pocket therebetween (in which case a separately formed second panel 42 can be omitted). In other examples, the main body 32 can comprise the frame pocket 100, such as between two layers of material of the main body at a central section thereof. In some such examples, the reinforcing member 34 may be omitted.

A hook-and-loop fastening mechanism (e.g., Velcro) can be used to removably couple the reinforcing member 34 to the main body 32 of the belt portion 14. For example, a loop portion 56 (FIG. 4B) of a hook-and-loop fastening mechanism can be secured to the outer side of the main panel 40 and a hook portion 58 can be secured to a central section of the main body 32 (FIG. 3). Alternatively, the loop portion 56 can be secured to the main body 32 and the hook portion 58 can be secured to the main panel 40. Other fastening mechanisms can be used to removably couple the reinforcing member 34 to the main body 32, such as snaps, clips, ties, screws, bolts, and/or other fastening means. In some examples, the reinforcing member 34 can be permanently secured to the main body 32 (that is, the reinforcing member 34 is not intended to be removed from the main body 32 in normal use), such as with stitching, an adhesive and/or mechanical fasteners.

Figure 5:
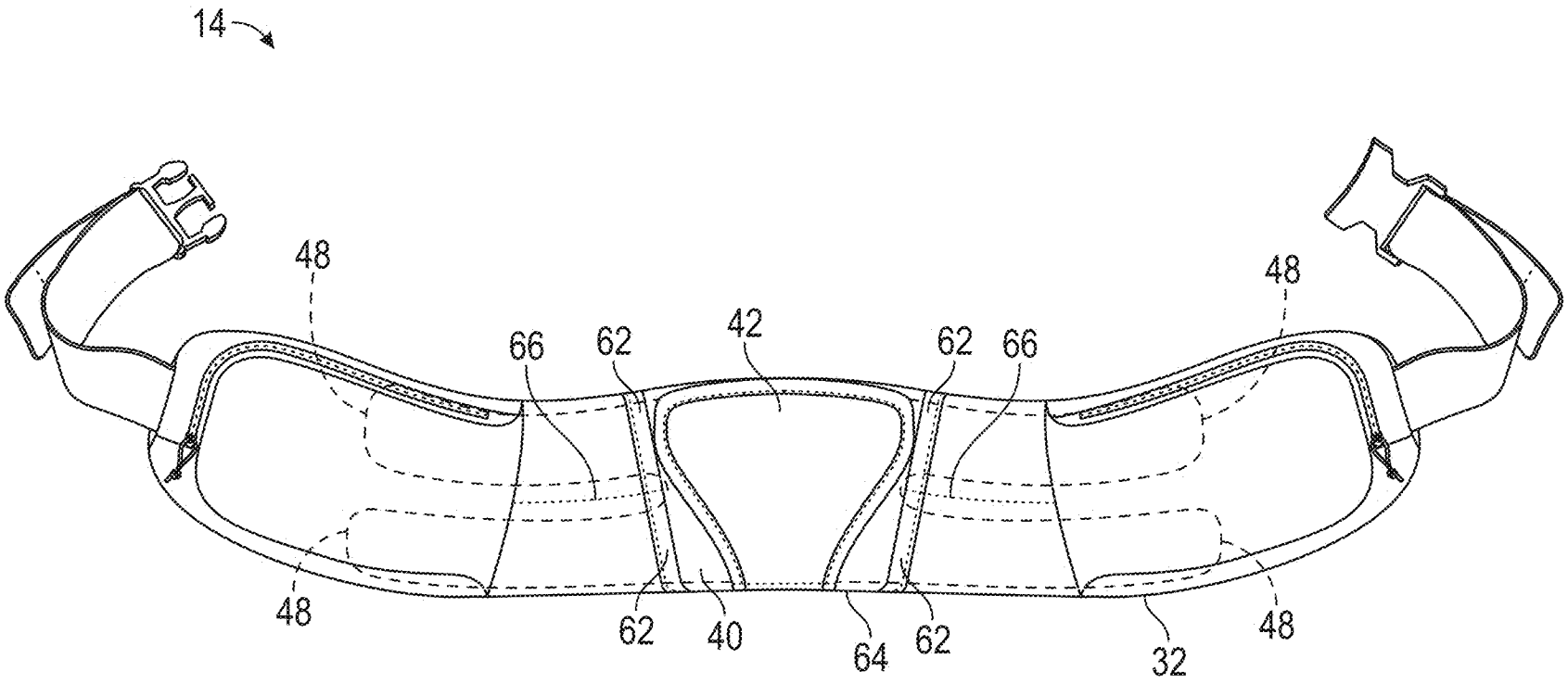
FIG. 5 is a perspective view of the belt portion of FIG. 3.

Turning now to FIGS. 3 and 5, the main body 32 can be formed with integral pockets 60 for receiving respective legs 48 of the reinforcing member 34. Each pocket 60 can have an open end 62 adjacent a central section 64 of the main body 32. Adjacent pockets 60 can be at least partially separated by stitching 66. To mount the reinforcing member 34 to the main body 32, the central section 44 of the main panel 40 is fastened to the main body using the hook and loop fastening mechanism (or via other fastening means) and each leg 48 is inserted into a respective pocket 60. In some examples, the legs 48 are sized such that when the belt portion 12 is worn around the waist of the user, the legs 48 extend from the back of the user around the sides of the waist at least over the hip bones of the user and optionally can further extend partially around the stomach of the user.

In some examples, the main panel 40 of the reinforcing member 34 is made of a material that is relatively more rigid than the main body 32 (such as the fabric and optional padding forming the main body 32) but flexible enough to wrap around the waist of the user. In this manner, the main panel 40 functions to receive the weight of the pack portion 12 via the frame 30 at the center section 44 and distribute the weight circumferentially along the legs 48 and around the waist of the user. This ensures that the weight of the pack portion 12 (and any contents) is more evenly distributed around the waist of the user and not so concentrated at the small of the back. In some examples, the main panel 40 is made of any of various polymers, such polyethylene, or any of various metals or metal alloys, such as aluminum, Nitinol or steel. When constructed of a metal, the main panel is formed sufficiently thin to be able to bend or flex when the belt portion is wrapped around and secured to the waist of the user. In some examples, the main panel 40 is made of a molded polymer, such as polyethylene.

Figure 6:
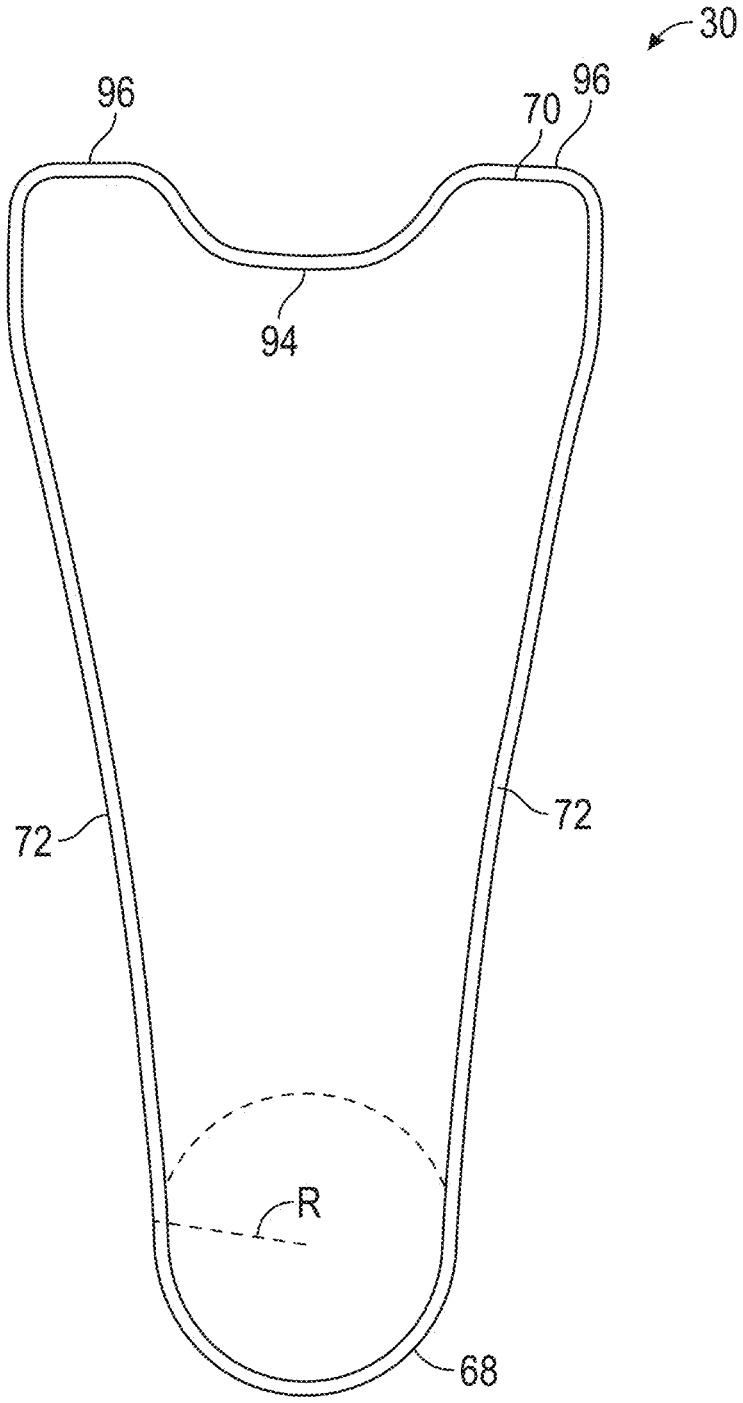
FIG. 6 is an elevational view of the frame of FIG. 3.

As best shown in FIG. 6, the frame 30 in the illustrated example comprises a lower portion 68, an upper portion 70, and two vertically extending side portions 72 extending between respective ends of the lower portion 68 and the upper portion 70. The upper portion 70 extends laterally between respective upper ends of the side portions 72. The side portions 72 can taper toward each other in a direction extending from the upper portion 70 toward the lower portion 68 such that the frame 30 is wider at the upper portion 70 than at the lower portion 68. The upper portion 70 can include a u-shaped bend or depression 94 and two straight portions 96, each extending from an adjacent end of the bend 94 to the upper end of one of the side portions 72. In some examples, the bend 94 can be positioned between upper end portions of the shoulder straps 16 of the pack portion 12 and provides a space above the bend that allows a user to tilt their head back without contacting the frame.

The frame 30 can be formed from a relatively rigid material sufficient to support the weight of the pack portion 12 and contents stored therein. Example materials include any of various metals and alloys, such as aluminum, titanium, steel, any of various polymers, or any of various composite materials, such as carbon fiber composite. In some examples, the frame 30 does not have any free ends; that is, the upper portion 70, the side portions 72, and the lower portion 68 form a closed shape. In some examples, the frame 30 can be formed by bending a metal rod (e.g., an aluminum rod) into the shape shown in FIG. 6 and then welding the ends of the rod together to form a closed shape.

Figure 7:
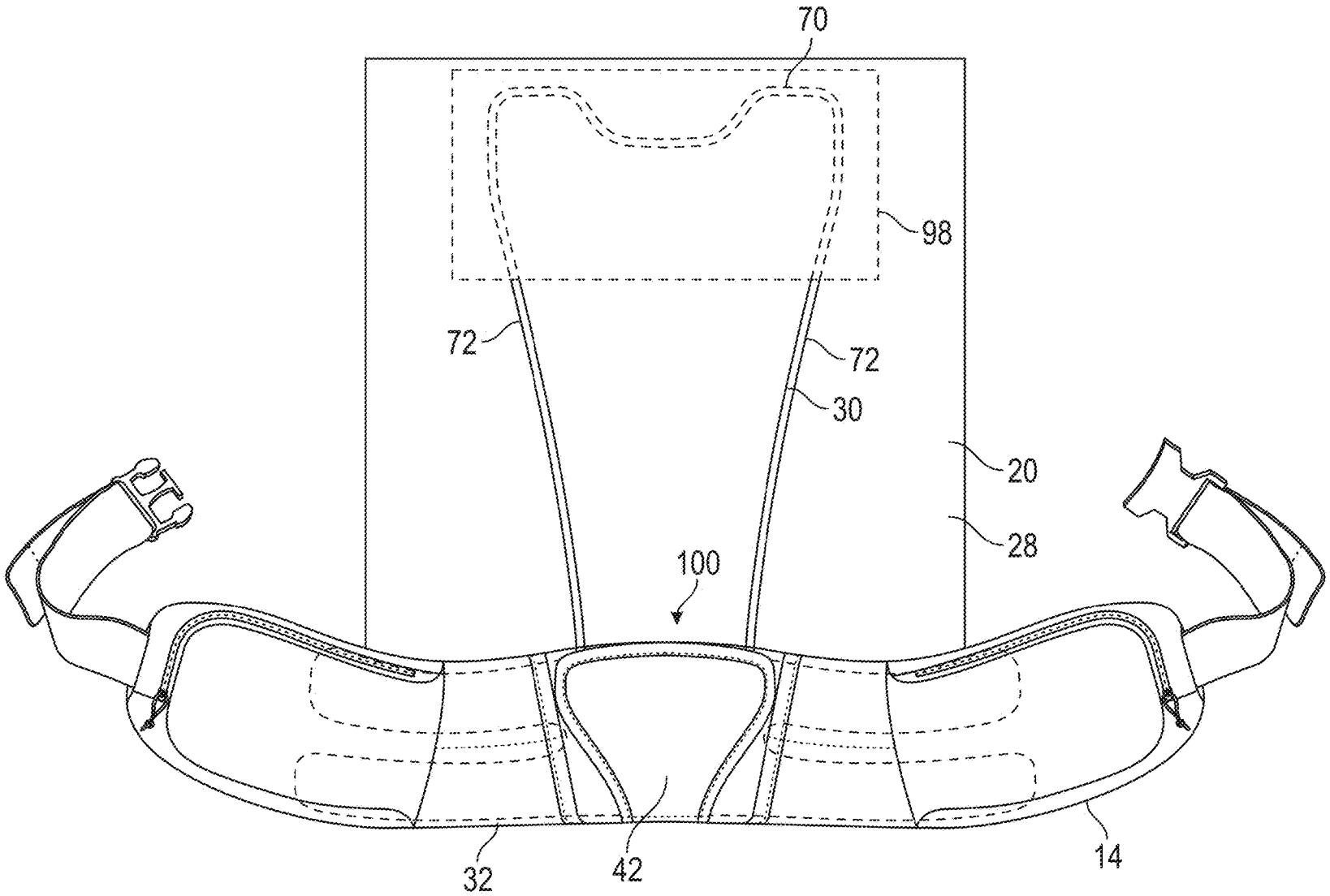
FIG. 7 is a perspective view of the frame and the belt portion of FIG. 3.
Figure 8:
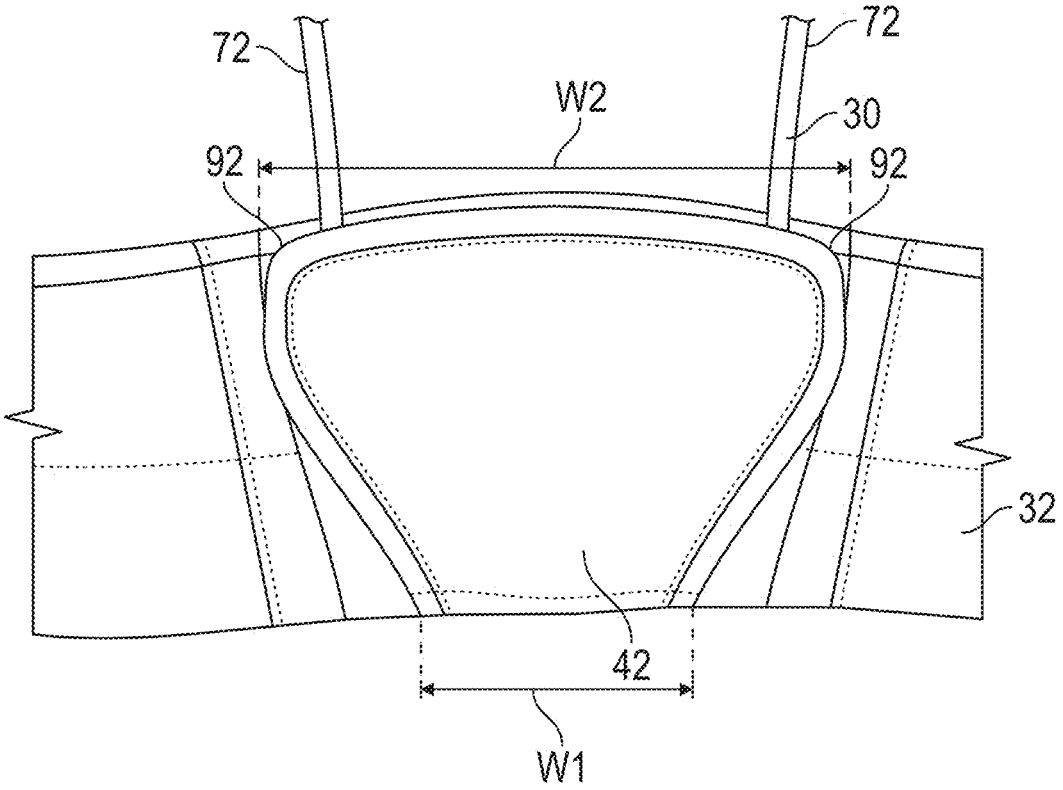
FIG. 8 is an enlarged view of a central section of the belt portion of FIG. 3 showing a lower portion of the frame received within a frame pocket of the belt portion.
Figure 9:
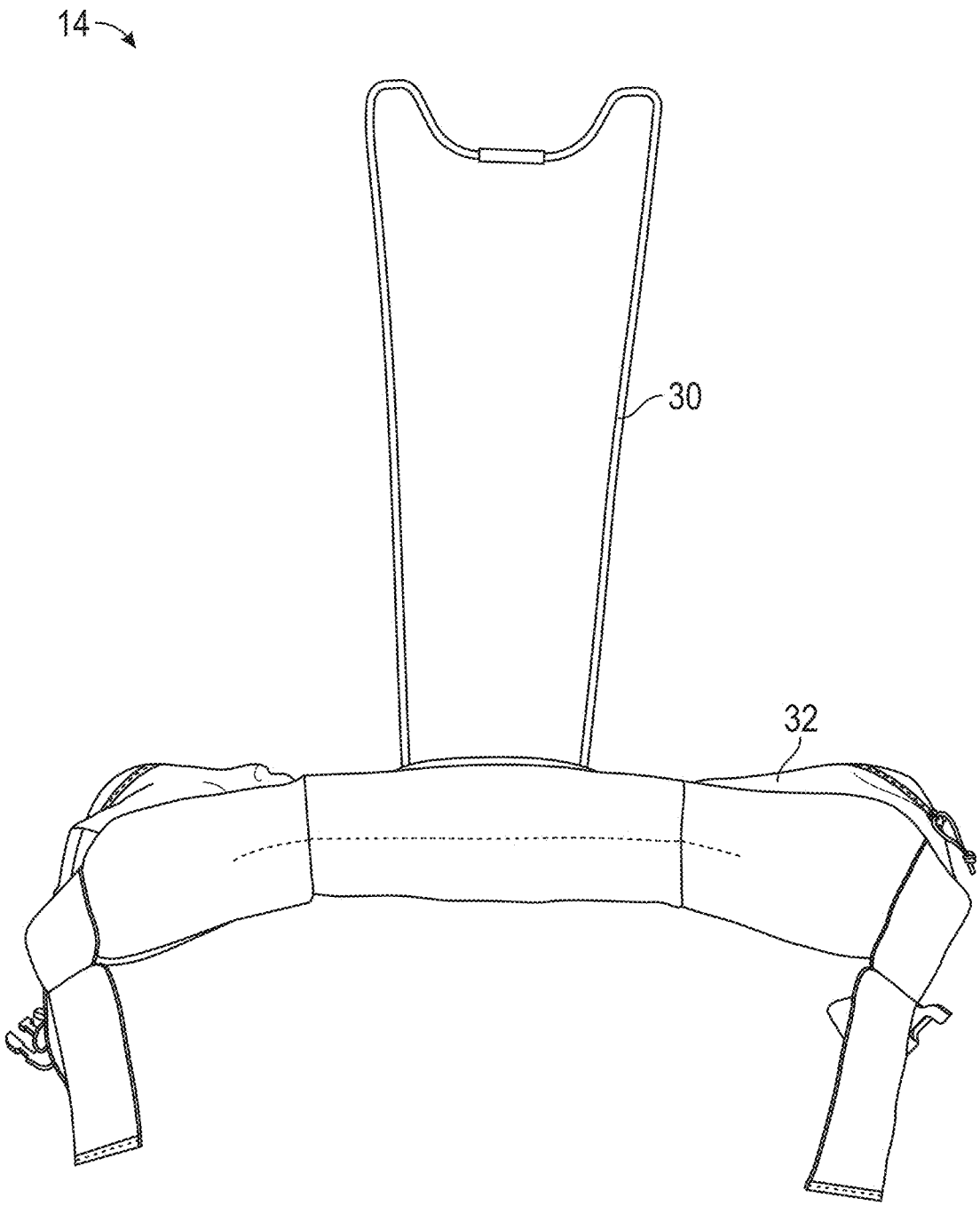
FIG. 9 is another perspective view of the frame and the belt portion of FIG. 3.

As shown in FIGS. 7-9, the lower portion 68 of the frame is received in the frame pocket 100 formed between the main panel 40 and the second panel 42 of the reinforcing member 34. When the backpack 10 is fully assembled, the upper portion 70 and the side portions 72 are coupled to the backside 20 of the pack portion 12, and the lower portion 68 of the frame is received in the frame pocket 100 of the belt portion 14 so as to transfer weight from the pack portion 12 to the belt portion 14. In some examples, the side portions 72 can extend behind the panel 28 or within respective pockets or channels formed in the panel 28. The upper portion 70 of the frame can be received in a pocket formed in the pack portion 12 adjacent the intersection between the backside 20 and the top side 24.

FIG. 7 schematically shows a pocket 98 formed along the backside 20 of the pack portion 12. The pocket 98 can be formed in the back panel 28 or can be a separate piece of material attached (e.g., stitched) to the inner surface or outer surface of the back panel 28 and is sized to receive the upper portion 70 of the frame and optionally at least portions of the side portions 72. Various other techniques or mechanisms can be used to couple the upper portion 70 and/or the side portions 72 to the pack portion 12, such as straps extending around the upper portion 70 and/or the side portions 72.

The lower portion 68 of the frame 30 is curved to allow pivoting movement of the belt portion 14 relative to the frame 30 and the pack portion 12 as the user's hips move up and down while walking. In some examples, the lower portion 68 is shaped to correspond to a portion of a circle, such as a half-circle having radius R. In some examples, the lower portion 68 has a radius R in the range of 2 inches to 4 inches, with 2.5 inches being a specific example. In some examples, the diameter of the lower portion 68 is smaller than the width of the upper portion 70 of the frame. The upper portion 70 can be relatively wider to adequately support the load of the pack portion 12, while lower portion 68 can be relatively smaller so as not to inhibit pivoting motion of the belt portion 14. In other examples, the width of the upper portion 70 can be equal to or less than the diameter of the lower portion 68.

Figure 10:
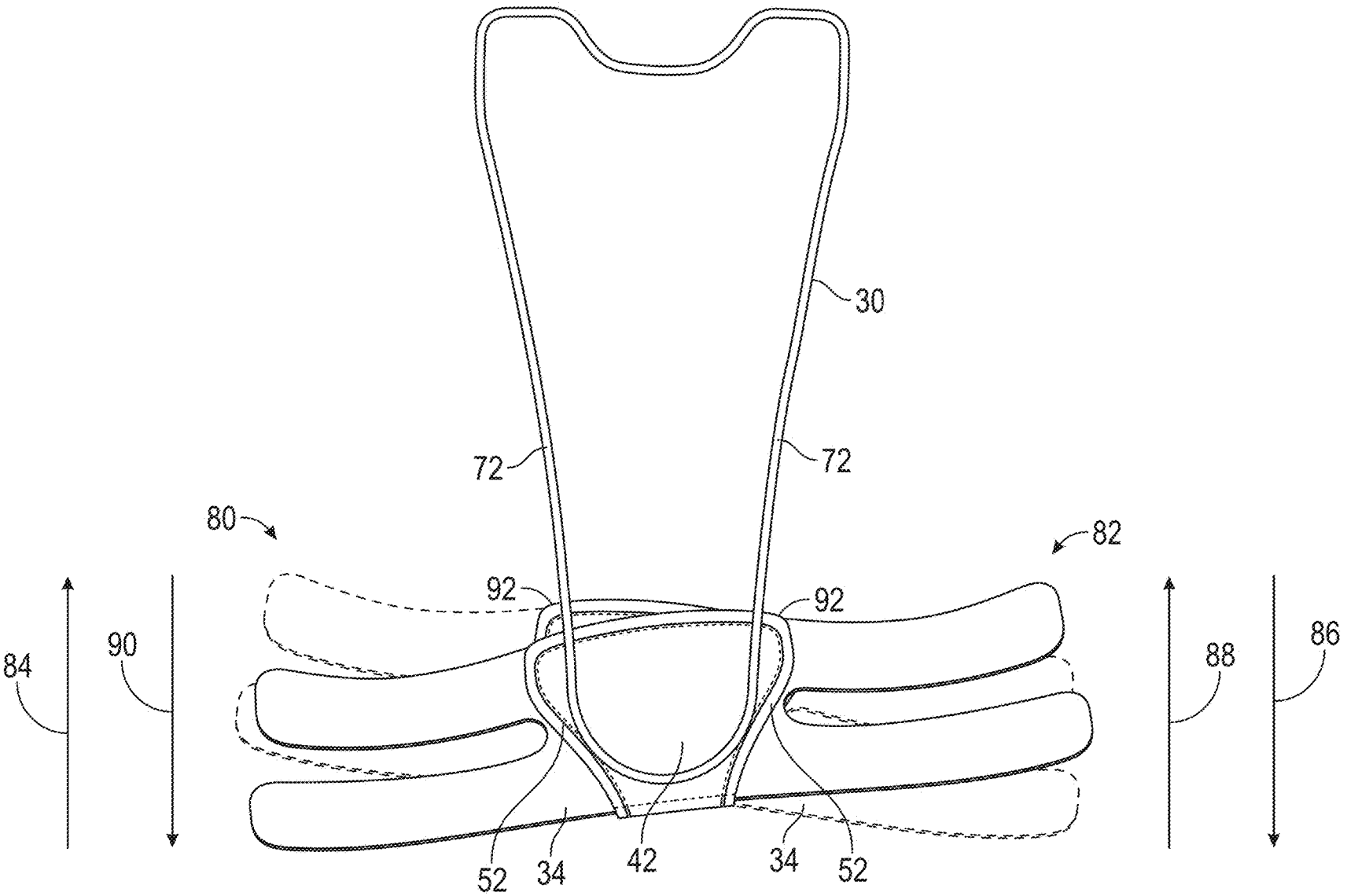
FIG. 10 illustrates the relative motion between the frame and the reinforcing member of the belt portion that occurs while being worn by a user who is walking.

FIG. 10 illustrates the rocking or pivoting movement of the reinforcing member 34 relative to the frame 30 while walking. The rocking movement of the reinforcing member 34 represents the movement of the belt portion 14 relative to the frame 30 and the pack portion 12. During normal walking or hiking, the hips of an average human move up and down about two inches. When the right leg and hip move upwardly, the right side 80 of the reinforcing member 34 (and belt portion 14) pivot upwardly in the direction of arrow 84 while the left side 82 of the reinforcing member 34 (and belt portion 14) pivot downwardly in the direction of arrow 86. This position of the reinforcing member 34 is shown in dashed lines for purposes of illustration. Similarly, when the left leg and hip move upwardly, the left side 82 of the reinforcing member 34 (and belt portion 14) pivot upwardly in the direction of arrow 88 while the right side 80 of the reinforcing member 34 (and belt portion 14) pivot downwardly in the direction of arrow 90. This position of the reinforcing member 34 is shown in solid lines. The ability of the belt portion 14 to pivot relative to the pack portion 12 allows for the pack portion to follow the movement of the user's back while the belt portion can follow the user's waist, thereby allowing the belt portion to maintain a substantially equal distribution of weight on the user's hips and greatly improving the comfort of the user while walking or hiking.

The reinforcing member 34 also can be configured to limit the extent that the belt portion 14 can pivot relative to the pack portion 12 to prevent over-pivoting of the belt portion. For example, in the illustrated example, the second panel 42 has a generally trapezoidal shape that has a narrow width W1 at the bottom of the frame pocket and a relatively greater width W2 at the top of the frame pocket (see FIG. 8). This allows the curved lower portion 68 of the frame to rotate within the frame pocket. As the lower portion 68 rotates, a side portion 72 of the frame 30 eventually comes into contact with an adjacent upper end 92 of the side edge 52 of the second panel 42. Thus, the frame can rotate side-to-side within the frame pocket to the extent allowed by the upper ends 92 of the side edges 52. In this manner, the side edges 52 of the second panel 42 function as stops or motion-limiting members that prevent over-pivoting of the belt portion 14.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A backpack comprising:

a pack portion adapted to receive and store contents;

a belt portion adapted to be worn around a waist of a user; and a frame coupled to the pack portion and the belt portion;

wherein the belt portion comprises a main body and reinforcing member coupled to the main body, wherein the reinforcing member comprises a frame pocket that receives a lower portion of the frame and allows the belt portion to pivot relative to the frame and the pack portion;

wherein the reinforcing member is removably coupled to the main body with a hook-and-loop fastening mechanism.

2. The backpack of claim 1, wherein the lower portion of the frame has a single radius of curvature.

3. The backpack of claim 1, wherein the reinforcing member comprises a first panel and a second panel connected to the first panel, wherein the first panel and the second panel form the frame pocket.

4. The backpack of claim 3, wherein the first panel comprises a central section and two side sections extending laterally from opposite sides of the central section, wherein the side sections are sized to extend over the hips of a user.

5. The backpack of claim 4, wherein each side section comprises a plurality of legs extending from opposite sides of the central section.

6. The backpack of claim 5, wherein each leg is disposed within a respective pocket in the main body of the belt portion.

7. The backpack of claim 3, wherein the first panel is more rigid than the main body of the belt portion.

8. The backpack of claim 7, wherein the first panel is made of a molded polymer.

9. The backpack of claim 1, wherein the frame comprises two upwardly extending, laterally spaced side portions that extend upwardly from opposing ends of the lower portion and an upper portion that extends laterally between upper ends of the side portions.

10. The backpack of claim 9, wherein the side portions and the upper portion of the frame extend into the pack portion.

11. A backpack comprising:

a pack portion adapted to receive and store contents;

two shoulder straps connected to the pack portion;

a belt portion adapted to be worn around a waist of a user, the belt portion comprising a frame pocket; and a frame comprising an upper portion and a lower portion, wherein the upper portion is coupled to the pack portion and the lower portion is disposed in the frame pocket of the belt portion such that the frame can transfer weight from the pack portion to the belt portion;

wherein the frame pocket can pivot relative to the lower portion of the frame such that the belt portion can pivot relative to the frame and the pack portion;

wherein the belt portion comprises a main body configured to be worn around a waist of a user and a reinforcing member coupled to the main body, wherein the reinforcing member comprises the frame pocket;

wherein the reinforcing member is removably coupled to the main body with a hook-and-loop fastening mechanism.

12. The backpack of claim 11, wherein the reinforcing member comprises a panel that is more rigid than the main body of the belt portion, wherein the panel comprises a central section forming at least a portion of the frame pocket and two side sections extending laterally from opposite sides of the central section, wherein the side sections are sized to extend over the hips of a user.

13. The backpack of claim 12, wherein the side sections are disposed in respective pockets in the main body of the belt portion.

14. The backpack of claim 12, wherein the panel comprises a first panel and the reinforcing member comprises a second panel attached to the central section of the first panel, wherein the first panel and the second panel form the frame pocket.

15. The backpack of claim 11, wherein the upper portion of the frame is disposed in a pocket in the pack portion.

16. The backpack of claim 11, wherein the frame comprises a bent metal rod.

17. The backpack of claim 16, wherein the lower portion of the frame has a curvature corresponding to a portion of a circle.

18. A backpack comprising:

a pack portion adapted to receive and store contents;

two shoulder straps connected to the pack portion, wherein the shoulder straps are adapted to be worn over the shoulders of a user so as to support the pack portion against the user's back;

a belt portion comprising a main body configured to be worn around a waist of the user and a reinforcing member coupled to the main body, wherein the reinforcing member is removably coupled to the main body with a hook-and-loop fastening mechanism, wherein the reinforcing member comprises a first panel and a second panel attached to the first panel to form a frame pocket, wherein the first panel comprises a central section and two side sections extending laterally from opposite sides of the central section, wherein each side section comprises a plurality of legs sized to extend over a hip of a user; and a frame comprising a bent metal rod, wherein the rod comprises a curved lower portion, two side portions extending upwardly from respective ends of the lower portion, and an upper portion extending laterally between respective upper ends of the side portions, wherein the curved lower portion has a curvature corresponding to a portion of a circle, wherein the upper portion is coupled to the pack portion and the lower portion is disposed in the frame pocket of the belt portion such that the frame can transfer weight from the pack portion to the belt portion;

wherein the frame pocket can pivot relative to the lower portion of the frame such that the belt portion can pivot relative to the frame and the pack portion.

* * * * *